US008146252B2

(12) United States Patent
Wirth

(10) Patent No.: US 8,146,252 B2
(45) Date of Patent: Apr. 3, 2012

(54) PROCESS FOR MANUFACTURING EXHAUST GAS TREATMENT DEVICE, E.G., EXHAUST GAS CATALYTIC CONVERTERS AND PARTICLE FILTERS

(75) Inventor: Georg Wirth, Kirchheim/Teck (DE)

(73) Assignee: J. Eberspächer GmbH & Co. KG, Esslingen (DE)

( * ) Notice: Subject to any disclaimer, the term of this patent is extended or adjusted under 35 U.S.C. 154(b) by 871 days.

(21) Appl. No.: 12/133,577

(22) Filed: Jun. 5, 2008

(65) Prior Publication Data

US 2008/0301940 A1 Dec. 11, 2008

(30) Foreign Application Priority Data

Jun. 6, 2007 (DE) ..... 10 2007 026 810

(51) Int. Cl.
*B21D 51/16* (2006.01)
*F01N 3/10* (2006.01)

(52) U.S. Cl. ..... 29/890; 422/171; 422/177

(58) Field of Classification Search ..... None
See application file for complete search history.

(56) References Cited

U.S. PATENT DOCUMENTS

| | | | | |
|---|---|---|---|---|
| 4,969,264 | A * | 11/1990 | Dryer et al. | 29/890 |
| 5,755,025 | A * | 5/1998 | Wirth et al. | 29/840 |
| 6,389,693 | B1 | 5/2002 | Aranda et al. | |
| 6,954,988 | B2 * | 10/2005 | Mayfield | 29/890 |
| 7,111,392 | B2 * | 9/2006 | Irie et al. | 29/890 |
| 7,451,660 | B2 * | 11/2008 | Martin | 73/819 |
| 7,900,352 | B2 * | 3/2011 | Mayfield | 29/890 |
| 2002/0057998 | A1 * | 5/2002 | Foster et al. | 422/179 |
| 2005/0005446 | A1 | 1/2005 | Mayfield | |
| 2006/0085980 | A1 | 4/2006 | Mayfield | |
| 2007/0212269 | A1 * | 9/2007 | Kobayashi et al. | 422/168 |

FOREIGN PATENT DOCUMENTS

| | | |
|---|---|---|
| DE | 26 04 886 | 8/1977 |
| DE | 602 05 738 | 7/2006 |
| EP | 0 681 095 | 11/1995 |
| EP | 0 982 480 | 3/2000 |
| WO | WO 03033886 | 4/2003 |
| WO | WO 2006094534 | 9/2006 |
| WO | WO2006136214 | 12/2006 |
| WO | WO 2007/101468 | 9/2007 |

* cited by examiner

*Primary Examiner* — Nina Bhat
(74) *Attorney, Agent, or Firm* — McGlew and Tuttle, P.C.

(57) ABSTRACT

A process is provided for manufacturing an exhaust gas treatment device (1), which contains at least one exhaust gas treatment insert (2) in a tubular housing (4), especially for an exhaust system of an internal combustion engine. A circumferential geometry of the at least one insert (2) is measured in at least one axial section of the particular insert (2). The at least one insert (2) is inserted axially into the housing (4). The measured circumferential geometry of the at least one insert (2) is taken into account during the deformation of the housing (4).

16 Claims, 4 Drawing Sheets

PROCESS FOR MANUFACTURING EXHAUST GAS TREATMENT DEVICE, E.G., EXHAUST GAS CATALYTIC CONVERTERS AND PARTICLE FILTERS

CROSS REFERENCE TO RELATED APPLICATIONS

This application claims the benefit of priority under 35 U.S.C. §119 of German Patent Application DE 10 2007 026 810.8 filed Jun. 6, 2007, the entire contents of which are incorporated herein by reference.

FIELD OF THE INVENTION

The present invention pertains to a process for manufacturing an exhaust gas treatment device, which contains in a tubular housing at least one exhaust gas treatment insert, especially for an exhaust system of an internal combustion engine. The present invention pertains, in addition, to an exhaust gas treatment device, especially to an exhaust system of an internal combustion engine, which contains at least one exhaust gas treatment insert in a tubular housing.

BACKGROUND OF THE INVENTION

Exhaust gas treatment devices, e.g., catalytic converters and particle filters, have at least one insert, which is arranged in a tubular housing. In particular, inserts made of ceramic materials are known. Metallic inserts are known as well. It is common to arrange the particular insert in the particular housing by means of a mounting mat enveloping the insert. This mounting mat has a plurality of functions. On the one hand, it absorbs lateral accelerations, to which the exhaust gas treatment insert may be exposed during operation. On the other hand, the mounting mat can form a thermal insulation in order to reduce the thermal load of the housing. Furthermore, fixation of the position of the insert in the housing is regularly achieved with the mounting mat. The mounting mat must be pressed for this purpose radially between the insert and the housing. For the radial pressing of the mounting mat, it is known that the insert wrapped into the mounting mat can be pushed axially into the housing, and the housing still has an excessively high internal cross section in this state. The housing is subsequently compressed, i.e., radially deformed, until the desired pressing of the mounting mat is achieved.

In case of ceramic inserts, especially when they are designed as a monolith, the radial pressing of the mounting mat is comparatively problematic, because damage to the ceramic inserts may occur when excessive forces occur. This is combined with the circumstance that the inserts, especially ceramic monoliths, may have comparatively great shape tolerances, as a result of which local stress peaks may develop during the radial deformation of the housing. Furthermore, a radial gap, which is formed between the particular insert and the housing and is filled by the mounting mat, may have a nonuniform, radially measured gap dimension in the circumferential direction. In case of unfavorable tolerance chains, the gap dimension may now become so large that the mounting mat will not be pressed there sufficiently, which may cause the mounting mat to become detached during operation at this insufficiently pressed location, as a result of which a bypass bypassing the insert is formed in the housing.

A process for preparing catalytic converters, in which a rupture characteristic of the ceramic monolith, which depends on the particular combination of ceramic material and mounting mat material, is first determined, is known from U.S. Pat. No. 6,954,988 B2. This rupture characteristic contains especially the dependence of the forces occurring during the pressing of the mounting mat on the velocity at which the pressing is carried out. The pressing of the mounting mat is carried out in the prior-art process such that damage to the monolith is avoided.

SUMMARY OF THE INVENTION

The present invention pertains to the problem of providing an improved embodiment for a manufacturing process of the type mentioned in the introduction or for an exhaust gas treatment insert of the type mentioned in the introduction, which improved embodiment is characterized in that the risk of damage to the insert during the manufacture is reduced and/or that a comparatively uniform shape of the gap is obtained in the circumferential direction.

This problem is solved by present invention. The present invention is based on the general idea of measuring the circumferential geometry in the particular insert before insertion into the housing at least in one axial section and of taking into account the measured circumferential geometry during the subsequent deformation of the housing. As a result, the deformation of the housing can take into account especially tolerance-related shape deviations of the particular insert. As a result, stress peaks can be avoided, on the one hand. On the other hand, the radial pressing of the mounting mat can be carried out more uniformly.

In particular, the process can be carried out such that at least in an axial section of the housing associated with the particular axial section of the at least one insert, a circumferential geometry of the housing is deformed as a function of the measured circumferential geometry of the at least one insert such that a predetermined gap shape will become established in the circumferential direction for a gap formed radially between the housing and the at least one insert. The predetermined shape of the gap can take into account especially an optimal pressing of the mounting mat. The predetermined shape of the gap can also take into account anisotropic load limits of the particular insert. Since the gap dimension that can be attained is correlated with the radial pressing of the mounting mat and hence with the forces occurring during pressing, the load on the particular insert during the deformation of the housing can also be determined via the preset value of the gap dimension.

Corresponding to an advantageous embodiment, the particular measured circumferential geometry of the particular insert can be associated with predetermined segments of the circumference of the insert, and an averaged circumferential geometry can, then, in addition, be determined from the circumferential geometry values measured in the particular circumferential segment. The deformation of the housing will then likewise take place in circumferential segments, which are associated with the circumferential segments of the particular insert, and the averaged circumferential geometries are taken into account by the deformation of the housing in the housing-side circumferential segments. This procedure takes into account especially deforming tools that have segmented shaping bodies arranged distributed in the circumferential direction.

The circumferential geometry of the particular insert is determined and taken into account at least in one axial section of the insert. It is clear that a plurality of axial sections can also be measured with respect to their circumferential geometry in other embodiments. A corresponding number of axial sections of the housing can then correspondingly also be deformed as a function of the particular circumferential geometries measured during the shaping of the housing. Any desired resolution in the longitudinal direction is also conceivable, in principle. For example, the complete outer contour of the particular insert can be determined, e.g., by so-called 3D scanning. The length geometry of the particular insert can thus additionally also be taken into account during the deformation of the housing.

An exhaust gas treatment device that is manufactured by the process according to the present invention can be characterized, for example, in that the housing has a cross section adapted to the cross section of the insert, even if the particular insert has an asymmetrical cross section with respect to rotations about its central longitudinal axis. The cross section of the housing then imitates the particular asymmetry in question of the insert more or less accurately.

Ceramic monoliths, whose cell matrix has a grid of webs extending mutually at right angles to one another, have a pressure loadability varying as a function of the rotation position. The particular monolith has a higher loadability in parallel to webs than in the diagonal direction of the cells. The dependence of the pressure loadability of the particular insert on the rotation position thereof can be taken into account during the deformation of the housing. An exhaust gas treatment device, which has been manufactured by the process according to the present invention, can thus also be characterized especially in that the housing is shaped in an axial section associated with the particular insert such that a shape of the radial gap geometry becomes established in the circumferential direction, with which [shape] a shape that depends on the radial pressure loadability of the particular insert, which loadability varies with the rotation position, is taken into account in the circumferential direction of the radial pressing of the mounting mat.

It is apparent that the above-mentioned features, which will still be explained below, are applicable not only in the particular combination described, but also in other combinations or alone, without going beyond the scope of the present invention.

Preferred exemplary embodiments of the present invention are shown in the drawings and will be explained in more detail below in the following description, identical reference numbers referring to identical or similar or functionally identical components. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
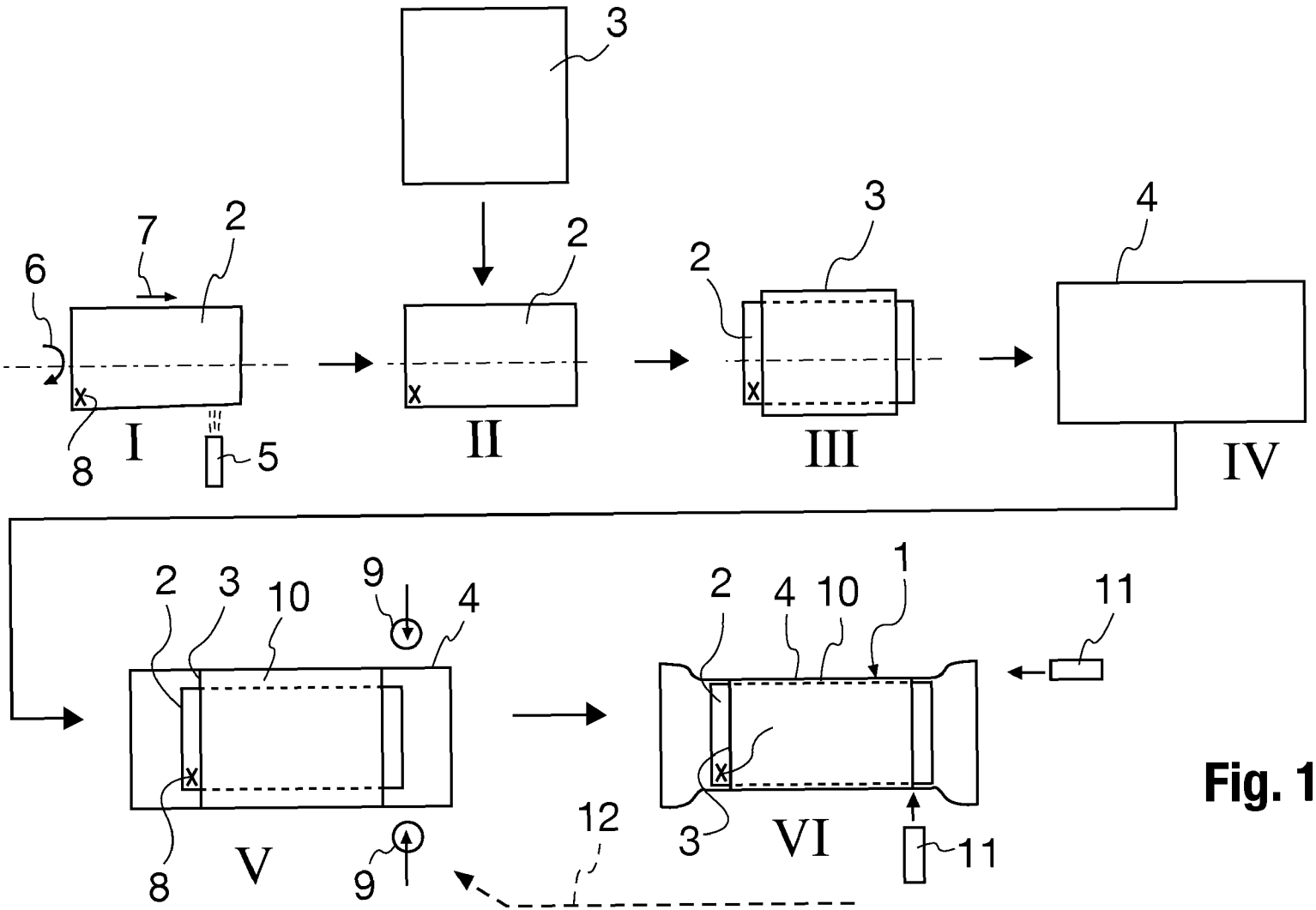
FIG. 1 is a greatly simplified schematic view showing the course of a manufacturing process according to the invention.

Referring to the drawings in particular, corresponding to FIG. 1, at least one exhaust gas treatment insert 2, at least one mounting mat 3 and a tubular housing 4 are needed to manufacture an exhaust gas treatment device 1, which is shown in FIG. 1 in an unfinished state only. The exhaust gas treatment device 1 may be, for example, a particle filter or a catalytic converter. The exhaust gas treatment device 1 is intended preferably for use in an exhaust system of an internal combustion engine, which may be arranged especially in a motor vehicle. The exhaust gas treatment insert 2, which will hereinafter also be called insert 2 for short, may thus be preferably a particle filter insert or a catalytic converter insert. The insert 2 may consist, in principle, of a metallic material. However, the insert 2 preferably consists of at least one ceramic monolith. The insert 2 may consist now of a single monolith; the insert 2 may likewise also be assembled from a plurality of monoliths.

The mounting mat 3 may be a wire knit fabric consisting of special steel or a fiber mat from a noncombustible material. The mounting mat 3 is compressible, but it develops a certain spring elasticity, which can be utilized in the mounted exhaust gas treatment device 1 to fix the position of the insert 2 in the housing 4.

Corresponding to FIG. 1, a circumferential geometry of the insert 2 is measured at I at least in an axial section of the insert 2. A corresponding measuring means is designated by 5 here. A rotation 6 between the insert 2 and the measuring means 5 may be necessary to detect the circumferential geometry. The circumferential geometry can be measured in a single axial section. It is assumed that the insert 2, which is manufactured especially according to the extrusion process, has a circumferential geometry that is constant in the axial direction. However, the insert 2 is preferably measured in a plurality of axial sections. It is likewise possible to measure the insert 2 continuously in the axial direction, i.e., the axial geometry of the insert 2 is measured as well. An axial adjustment 7 between the insert 2 and the measuring means 5 may take place for this purpose.

The measurement of the insert 2 is carried out preferably in relation to a marking 8, which is symbolized by a cross here. This marking 8 may be present on the particular insert 2 anyway, for example, in the form of a longitudinal groove formed on the insert 2 in connection with the manufacture. The marking 8 may also be prepared on the insert 2 deliberately. For example, a line or the like can be applied to the insert 2 with a paint.

The insert 2 is provided with the mounting mat 3 at II. The insert 2 wrapped around with the mounting mat 3 is shown at III. The insert 2 wrapped around with the mounting mat 3 is now inserted into the housing 4 in the axial direction, which is shown at IV. Especially an inserting funnel can be used for the axial insertion. At any rate, the housing 4 has an oversize, whereby the axial insertion of the insert 2 provided with the yet non-pressed mounting mat 3 is facilitated.

The deformation of the housing 4 now takes place at V. Corresponding shaping tools are designated here by 9. The radial deformation of the housing 4 is necessary in order to achieve a desired radial pressing of the mounting mat 3. It is only through this radial pressing that the mounting mat 3 can assume its fixing action or fixing function. The pressed mounting mat 3 is used, among other things, to fix the position of the insert 2 relative to the housing 4. The circumferential geometry measured before at I and optionally the measured axial geometry are now taken into account during the deformation of the housing 4.

The measured circumferential geometry or axial geometry is taken into account, in particular, by a corresponding control of the shaping tool 9, which control is not shown here, such that a predetermined shape of the gap will become established in the circumferential direction for a gap 10, which is formed radially between the housing 4 and the insert 2 and in which the mounting mat 3 is arranged.

Depending on the design of the shaping tool 9, it may now be useful to associate the measured circumferential geometry to predetermined circumferential segments of the insert 2 and to determine for the circumferential segments an averaged circumferential geometry, which can be calculated on the basis of the circumferential geometry measured within the particular circumferential segment. For example, the shaping tool 9 has six shaping bodies in the circumferential direction, with which the housing 4 can be radially deformed. The insert 2 is correspondingly divided into six circumferential segments, with which a respective average circumferential geometry from the circumferential data measured within the particular circumferential segment is associated. During the shaping of the housing 4, the circumferential geometry of the housing 4 can then likewise be deformed as a function of the averaged circumferential geometries in circumferential segments, which are associated with the circumferential segments of the particular insert 2. The six shaping bodies are then actuated in the example individually corresponding to the averaged circumferential geometries of the insert 2, as a result of which the housing 6 is likewise deformed individually in six circumferential segments along its circumference.

Depending on the embodiment of the shaping tool available, the circumferential geometry of the insert 2 can be transformed at the housing 4 in a single axial section or in a plurality of axial sections or quasi continuously in the axial direction. The axial shape of the circumferential geometry of the housing 4 can correspondingly be deformed as a function of the axial shape of the circumferential geometry, which axial shape is measured in the insert 2, in such a way that a predetermined shape of the gap can also become established in the axial direction. Depending on the shaping tool 9, it may be useful in this case as well to associate the axial shape of the circumferential geometry of the insert 2, which axial shape can be measured per se continuously, to predetermined axial sections of the insert 2 and to determine an averaged circumferential geometry for the particular axial section from the measured values. The housing 4 can then be deformed as a function of the averaged circumferential geometries, likewise in axial sections, which are associated with the predetermined axial sections of insert 2.

It may be useful for the shaping operation of the housing 4 to take into account the marking 8. For example, the shaping tool 9 may automatically recognize the particular marking 8. It may likewise be necessary to insert the particular insert 2 into the housing 4 in a predetermined rotated position and/or axial position relative to its marking 8. The deformation of the housing 4 is then carried out with reference to the marking 8.

After the deformation of the housing 4, the mounting mat 3 is pressed radially, which can be recognized at VI. To ensure quality, provisions may be made at VI to measure the actual geometry of the housing 4, which geometry is formed by the deformation of the housing 4, or the actual geometry of the gap 10. Corresponding measuring means are designated by 11 here. Depending on the geometry measured on the insert 2 at I, a desired geometry can be determined for the housing 4 and for the gap 10, and this desired geometry can then be compared with the actual geometry measured at VI. Corresponding measuring means are designated by 11 here. Depending on the geometry measured on the insert 2 at I, a desired geometry can be determined for the housing 4 and for the gap 10, and this [desired geometry] can then be compared with the actual geometry measured at VI. The shaping tool 9 or a shaping device equipped therewith can be adapted automatically as a function of this desired-actual value comparison by means of a feedback 12.

Figure 2:
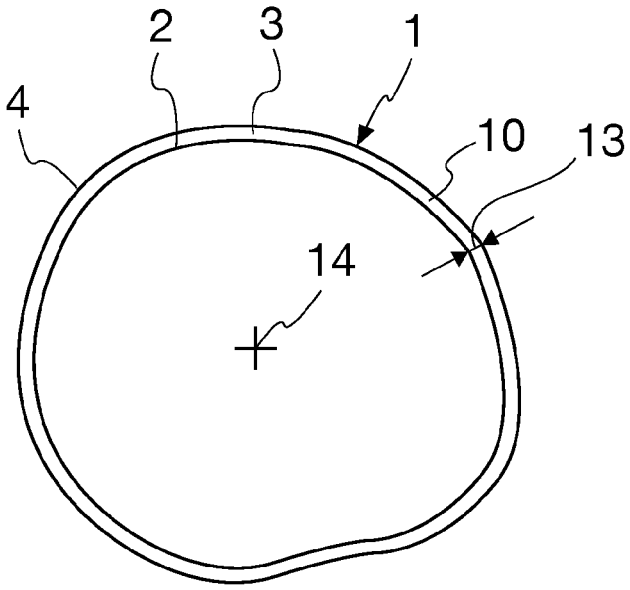
FIG. 2 is a schematic cross sectional view, shown in a greatly simplified form, of an embodiment of an exhaust gas treatment insert.

As was explained above, a gap shape predetermined in the circumferential direction and/or in the axial direction can be set more or less accurately by the procedure according to the present invention in the particular exhaust gas treatment device 1. This shape of the gap can be selected especially such that an essentially constant gap size will become established in the circumferential direction or in the axial direction. For example, FIG. 2 shows an embodiment, in which the exhaust gas treatment device 1 has a gap 10, in which the mounting mat 3 is arranged, between the insert 2 and the housing 4. The shape of the gap in the circumferential direction is characterized here in that the gap 10 has an essentially constant gap dimension in the circumferential direction. The gap dimension is the gap width 13 measured in the radial direction here. In an exaggerated view, FIG. 2 shows an insert 2, which has a cross section that is asymmetric in relation to rotations about the central longitudinal axis 14 of the insert 2. This embodiment of the exhaust gas treatment device 1 is characterized in that its housing 4 has, at least in the axial section associated with the insert 2, a cross section that is adapted to the asymmetric cross section of insert 2. The housing 4 follows the irregularities of the outer contour of insert 2.

Figure 3:
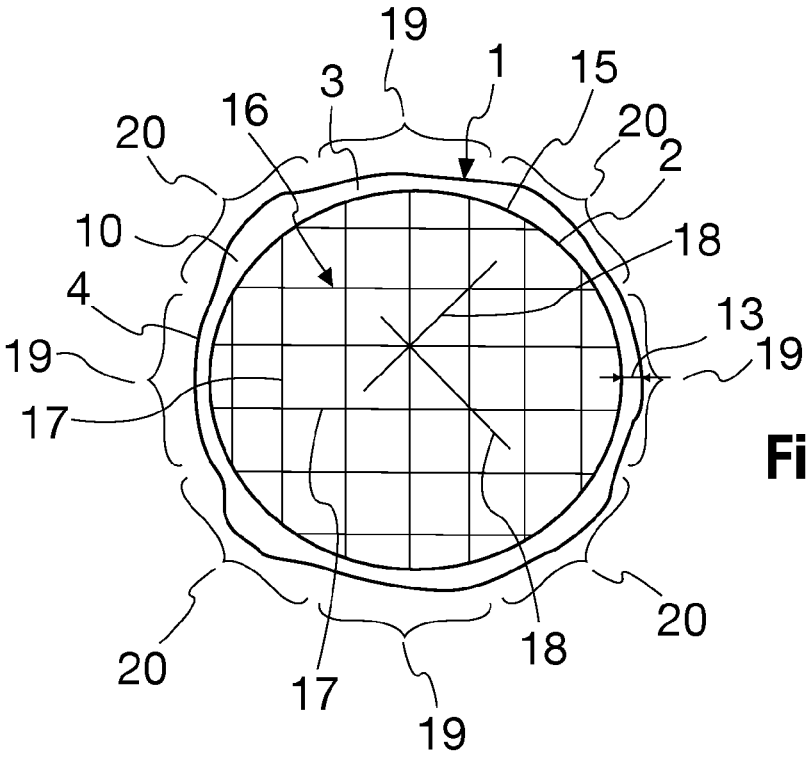
FIG. 3 is a schematic cross sectional view, shown in a greatly simplified form, of another embodiment of an exhaust gas treatment insert.

FIG. 3 shows, likewise in an exaggerated view, a special embodiment, in which the insert 2 is formed from at least one ceramic monolith 15. The monolith 15 has a cell matrix 16, which has a grid of webs 17 extending at right angles to one another. Such a monolith 15 has an anisotropic loadability for radial pressure loads. The pressure loadability of the monolith 15 is greater in case of pressure loads that extend in parallel to webs 17 than in case of pressure loads that are sloped in relation to the webs 17. The pressure loadability is lowest, in particular, in the direction of the diagonal 18 of the grid.

The shape of the gap predetermined in the circumferential direction or in the axial direction can now be selected for the shaping of the housing 4 specifically such that the radial pressure load of insert 2, which develops during the deformation of housing 4, takes place as a function of a pressure loadability of insert 2, which varies with the rotation position or axial position. This means that, in particular, the anisotropic pressure loadability of the insert 2 is taken into account during the pressing of the mounting mat 3. As a result, stronger pressing of the mounting mat 3 can be attained in areas that have a greater pressure loadability.

Corresponding to FIG. 3, the housing 4 is shaped, in case of an exhaust gas treatment device 1, which has been manufactured under these conditions, at least in an axial section associated with the particular insert 2, such that a shape becomes established in the circumferential direction for the radial gap geometry, which shape takes into account a shape of the radial pressing of the mounting mat 3 in the circumferential direction, which latter shape depends on the radial pressure loadability of insert 2, which said loadability varies with the rotation position. In the concrete example shown, the radial pressing of the mounting mat 3 is greater in circumferential segments 19, in which the webs 17 are oriented at right angles to the housing 4 at least in one middle area, than in other circumferential segments 20, in which the webs 17 are sloped by about 45° in relation to the housing 4 in a middle area of the respective circumferential segment 20. In these other circumferential segments 20, especially the diagonals 18 are directed essentially at right angles to the housing 4 at least in a middle area of the particular segment 20.

FIGS. 4 through 7 show, purely as examples and without restriction of the general scope, two different embodiments of shaping tools 9, by means of which the housing 4 can be deformed differently segment by segment in the circumferential direction and/or in the longitudinal direction, in order to make it possible to obtain the desired cross-sectional shape or gap shape in the circumferential direction and in the longitudinal direction. For example, the shaping tool 9 is equipped in the examples shown in FIGS. 4 through 7 with a plurality of tool segments 21, which are arranged distributed in the circumferential direction and with which a respective circumferential segment of the housing 4 is associated. The tool segments 21 are loaded for the shaping operation in the radial direction corresponding to arrows. The individual tool segments 21 can be driven individually with this radial pressing force. The individual tool segments 21 are preferably each routed. An averaged circumferential geometry can thus be associated with every individual tool segment 21, and this circumferential geometry will then be embodied on the housing 4 in the area of the respective circumferential segment.

Figure 4:
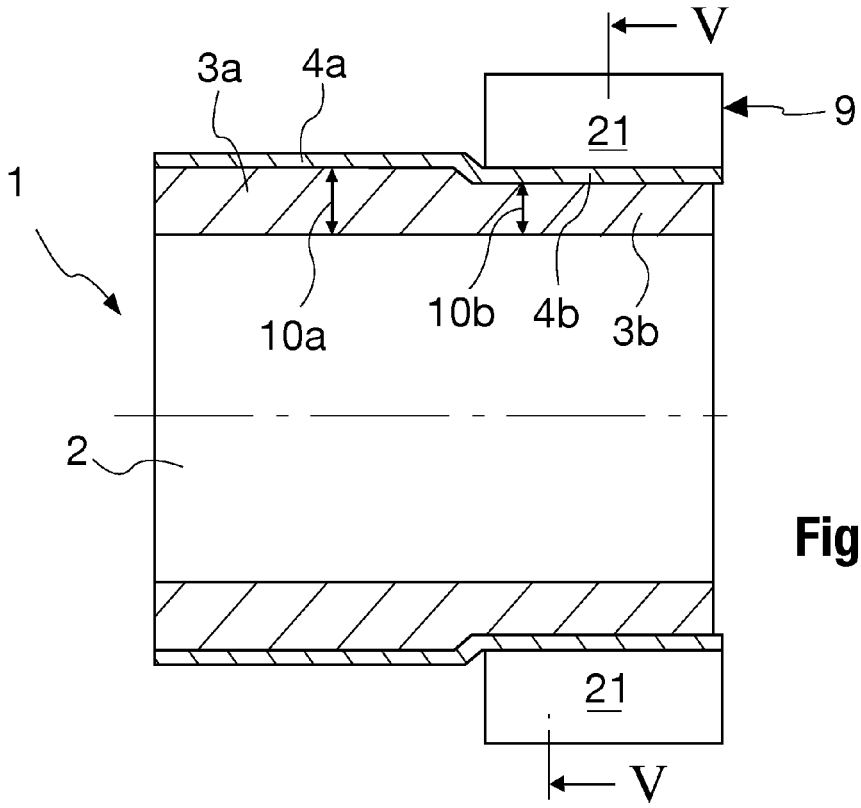
FIG. 4 is a longitudinal sectional view corresponding to position V in FIG. 1 through an exhaust gas treatment device during the deformation of its housing corresponding to section lines IV in FIG. 5.
Figure 5:
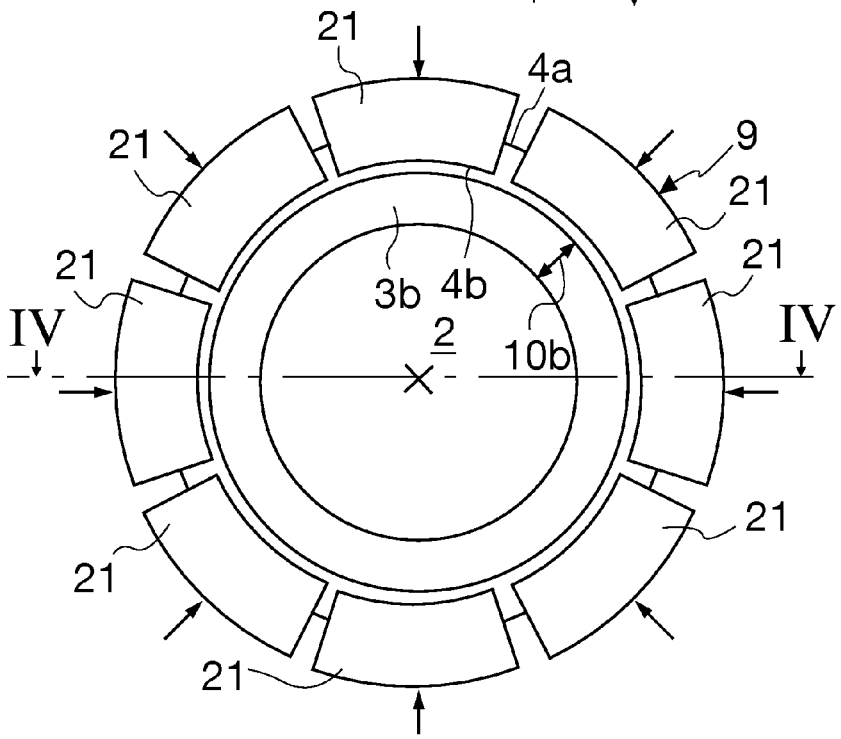
FIG. 5 is a cross sectional view through the exhaust gas treatment device from FIG. 4 corresponding to section lines V in FIG. 4.
Figure 6:
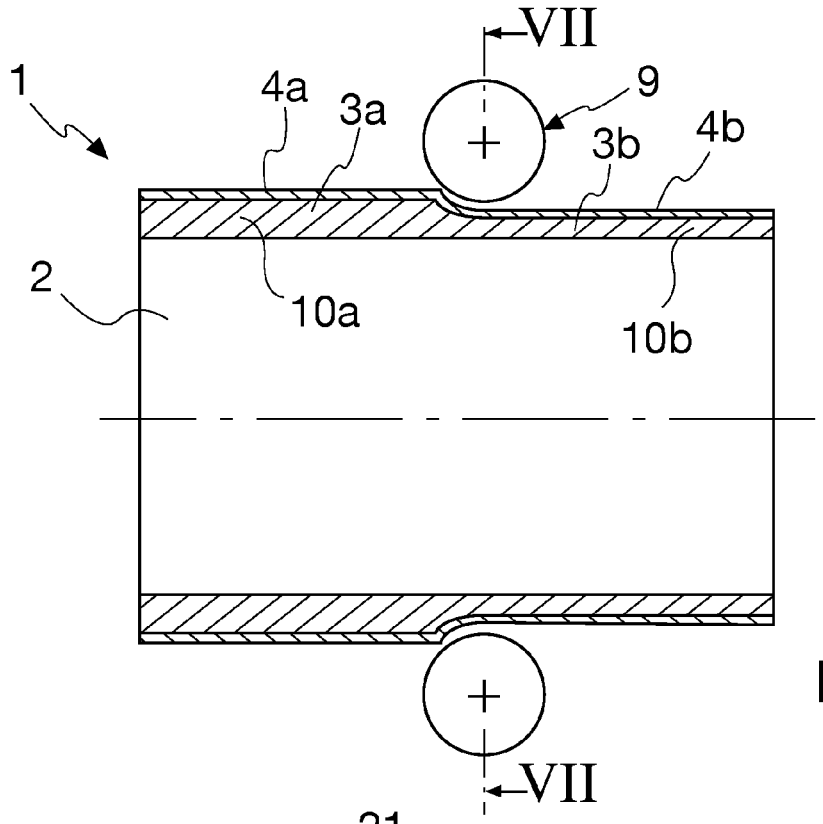
FIG. 6 is a longitudinal sectional view as in FIG. 4, but for another embodiment corresponding to section lines VI in FIG. 7.

In FIGS. 4 and 6, the mounting mat 3, the housing 4 and the gap 10 in the non-deformed state are designated by a, while the deformed state of these components is designated by b. The tool segments 21 may be shorter in the axial direction than the housing 4. As a result, different axial sections of the housing 4 can be shaped individually, i.e., with different average cross-sectional geometries in the area of the respective tool segments 21.

Figure 7:
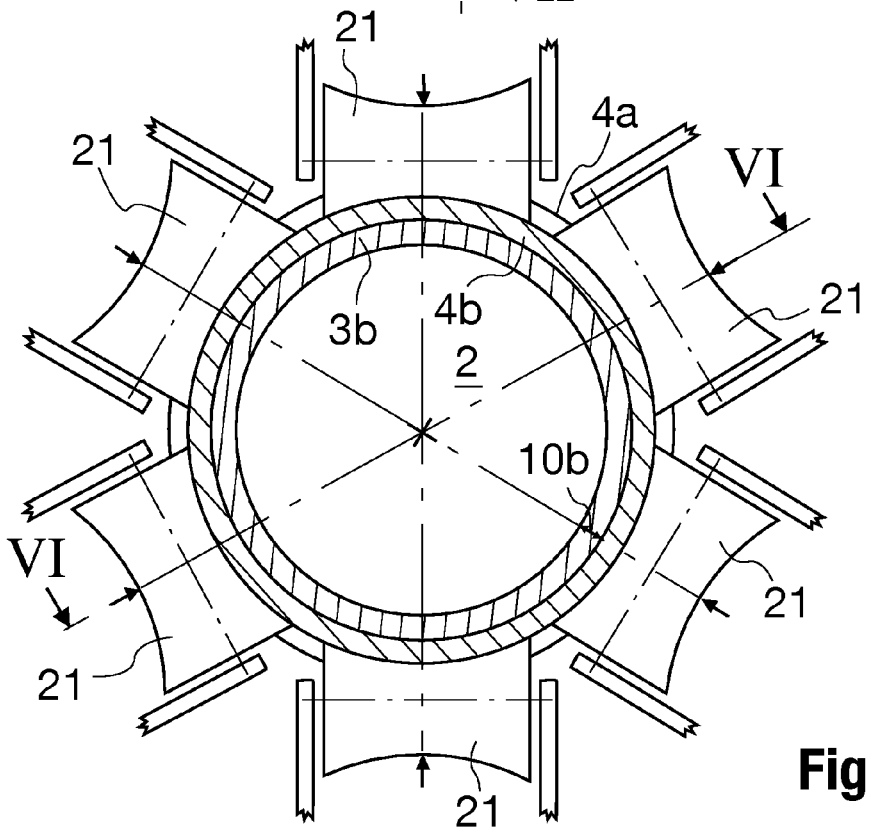
FIG. 7 is a cross sectional view as in FIG. 5, but for an embodiment corresponding to section lines VII in FIG. 6.

While the tool segments 21 are designed as shaping jaws in the embodiment according to FIGS. 4 and 5, FIGS. 6 and 7 show an embodiment in which the tool segments 21 are designed as shaping rollers, which are likewise designated by 21 below. The geometry of the shaping rollers 21 is adapted to the outer contour of the housing 4, which is clearly recognizable in FIG. 7. A relative axial motion can be carried between the housing 4 and the shaping rollers 21 during shaping. For example, the stationarily arranged shaping rollers 21 may be pushed or pulled axially through the housing 4. The desired deformation of the housing 4 now takes place in the radial direction, namely segment by segment corresponding to the shaping rollers 21, which are arranged distributed over the circumference and are associated with a circumferential segment each. A corresponding pressing force, which is represented by arrows in FIG. 7, is also applied to the shaping rollers 21 for shaping the housing 4 in the radial direction. The shaping rollers 21 are preferably routed in this case as well. It is possible, in principle, in this embodiment to set the shaping rollers 21 differently, doing so individually, for different axial sections of the housing 4 when pulling or pushing the housing 4 centrally through the shaping rollers 21. This may take place theoretically continuously. However, an embodiment in which the particular setting of the shaping rollers 21 is constant for a plurality of axial sections that follow each other axially is preferable, the feed of the housing 4 being interrupted for setting the shaping rollers by presetting new values of the cross-sectional geometry.

While specific embodiments of the invention have been shown and described in detail to illustrate the application of the principles of the invention, it will be understood that the invention may be embodied otherwise without departing from such principles.

What is claimed is:

1. A process for manufacturing a exhaust gas treatment device for an exhaust system of an internal combustion engine, which exhaust gas treatment device contains at least one exhaust gas treatment insert in a tubular housing, the process comprising the steps of:

measuring a circumferential geometry of the at least one insert in at least one axial section of said particular insert;

inserting the at least one insert axially into said housing; and deforming said housing taking into account the measured circumferential geometry of the at least one insert.

2. A process in accordance with claim 1, wherein deforming said housing includes deforming a circumferential geometry of said housing as a function of the measured circumferential geometry of said at least one insert at least in an axial section of said housing, which said axial section is associated with the partial axial section of the at least one insert, such that a predetermined gap shape becomes established in the circumferential direction to provide a gap formed radially between said housing and said at least one insert.

3. A process in accordance with claim 1, wherein:

the measured circumferential geometry of the at least one insert is associated with predetermined circumferential segments and an averaged circumferential geometry is determined for a particular circumferential segment; and the circumferential geometry of said housing is deformed in circumferential segments associated with the circumferential segments of the at least one insert as a function of the averaged circumferential geometries.

4. A process in accordance with claim 2, further comprising the steps:

measuring the axial shape of the circumferential geometry of the at least one insert; and deforming the axial shape of the circumferential geometry of said housing as a function of the measured shape of the at least one insert such that a predetermined gap shape will also become established in the axial direction.

5. A process in accordance with claim 4, wherein:

the measured axial shape of the circumferential geometry of the at least one insert is associated with predetermined axial sections and an averaged circumferential geometry is determined for the partial axial section; and the axial shape of said housing is deformed in axial sections associated with the axial sections of the at least one insert as a function of the averaged circumferential geometries.

6. A process in accordance with claim 1, wherein:

the measurement of said at least one insert is carried out with respect to a marking present or placed on the at least one insert; and the at least one insert is inserted into said housing in a predetermined relative position in relation to said marking, so that the deformation of said housing is carried out in relation to said marking of the at least one insert.

7. A process in accordance with claim 4, wherein the gap shape predetermined in the circumferential direction and/or in the axial direction is selected to be such that an essentially constant gap shape becomes established in the circumferential direction and/or in the axial direction.

8. A process in accordance with claim 7, wherein the gap shape predetermined in the circumferential direction and/or in the axial direction is selected to be such that the radial pressure load of the at least one insert, which occurs during the deformation of said housing, occurs as a function of a pressure loadability of the at least one insert, which varies as a function of the rotation position and/or the axial position.

9. A process in accordance with claim 1, wherein an actual geometry of said housing and/or of said gap, which is formed by the deformation of said housing, is measured and compared with a desired geometry determined as a function of the measured geometry of the at least one insert; and a shaping device carrying out the deformation of said housing is automatically adapted as a function of the desired value-actual value comparison.

10. A process for manufacturing a exhaust gas treatment device for an exhaust system of an internal combustion engine, the process comprising the steps of:

providing an insert with an axial direction, a radial direction and a circumferential direction;

measuring a circumferential geometry of the insert at a plurality of points in the circumferential direction;

providing a housing;

inserting the insert axially into said housing;

deforming the housing around the insert in the circumferential directions, said deforming being selective in the circumferential direction as a function of the measured circumferential geometry at the respective plurality of points in the circumferential direction.

11. A process in accordance with claim 10, wherein:

said deforming occurs in segments, and each of the segments include a plurality of the measured points in the circumferential direction;

determining an average of the measured points contained within a respective segment is performed;

said deforming selectively deforms the housing in each of the segments according to the average of the measured points contained within a respective segment.

12. A process in accordance with claim 11, wherein:

the insert has a varying radial loadability which varies in the circumferential direction;

said deforming selectively deforms the housing in the circumferential direction as a function of the varying radial loadability of the insert.

13. A process in accordance with claim 11, wherein:

said measuring includes measuring the circumferential geometry of the insert at a plurality of points in the axial direction;

said deforming includes deforming the housing against the insert in the axial direction, said deforming in the axial direction being selective as a function of the measured circumferential geometry at the respective plurality of points in the axial direction.

14. A process in accordance with claim 10, wherein:

the insert has a varying radial loadability which varies in the circumferential direction;

said deforming selectively deforms of the housing in the circumferential direction as a function of the varying radial loadability of the insert.

15. A process in accordance with claim 14, wherein:

said measuring includes measuring the circumferential geometry of the insert at a plurality of points in the axial direction;

said deforming includes deforming the housing against the insert in the axial direction, said deforming in the axial direction being selective as a function of the measured circumferential geometry at the respective plurality of points in the axial direction.

16. A process in accordance with claim 10, wherein:

said measuring includes measuring the circumferential geometry of the insert at a plurality of points in the axial direction;

said deforming includes deforming the housing against the insert in the axial direction, said deforming in the axial direction being selective as a function of the measured circumferential geometry at the respective plurality of points in the axial direction.

* * * * *